US010241532B2

(12) United States Patent
Sun et al.

(10) Patent No.: US 10,241,532 B2
(45) Date of Patent: Mar. 26, 2019

(54) PARTITION METHOD AND DEVICE FOR POWER SYSTEM

(71) Applicant: Tsinghua University, Beijing (CN)

(72) Inventors: Hongbin Sun, Beijing (CN); Qinglai Guo, Beijing (CN); Bin Wang, Beijing (CN); Boming Zhang, Beijing (CN); Wenchuan Wu, Beijing (CN); Huaichang Ge, Beijing (CN)

(73) Assignee: TSINGHUA UNIVERSITY, Beijing (CN)

( * ) Notice: Subject to any disclaimer, the term of this patent is extended or adjusted under 35 U.S.C. 154(b) by 656 days.

(21) Appl. No.: 14/850,657

(22) Filed: Sep. 10, 2015

(65) Prior Publication Data

US 2016/0098052 A1 Apr. 7, 2016

(30) Foreign Application Priority Data

Sep. 12, 2014 (CN) ..... 2014 1 0466901

(51) Int. Cl.
*G05F 1/625* (2006.01)
*G05F 1/66* (2006.01)

(52) U.S. Cl.
CPC ..... *G05F 1/625* (2013.01); *G05F 1/66* (2013.01)

(58) Field of Classification Search
CPC ..... G05F 1/625; G05F 1/66
USPC ..... 700/295
See application file for complete search history.

(56) References Cited

U.S. PATENT DOCUMENTS

2013/0155925 A1* 6/2013 Priyantha ..... H04W 52/0261 370/311
2014/0099881 A1* 4/2014 Boudreau ..... H04B 7/14 455/7
2017/0202993 A1* 7/2017 Huang ..... A61L 9/015

* cited by examiner

*Primary Examiner* — Bo Fan
(74) *Attorney, Agent, or Firm* — Kile Park Reed & Houtteman PLLC

(57) ABSTRACT

The present disclosure relates to a partition method and a partition device for a power system and belongs to a field of an evaluation and control of a power system. The method includes steps of: obtaining a quasi-steady sensitivity matrix according to generators participating in automatic voltage control and load buses in the power system; obtaining a power system model according to the quasi-steady sensitivity matrix and the load buses; determining principal component vectors and principal component singular values according to the power system model; determining a principal component vector dominated by each generator according to the principal component vectors and the principal component singular values; and partitioning the generators dominating a same principal component vector to a partition, and partitioning the load buses according to a partition result for the generators.

19 Claims, 2 Drawing Sheets

PARTITION METHOD AND DEVICE FOR POWER SYSTEM

CROSS-REFERENCE TO RELATED APPLICATION

This application claims priority to and benefits of Chinese Patent Application No. 201410466901.X, filed with the State Intellectual Property Office of P. R. China on Sep. 12, 2014, the entire contents of which are incorporated herein by reference.

TECHNICAL FIELD

The present disclosure relates to a field of an evaluation and control of a power system, and more particularly relates to a partition method for a power system and a partition device for a power system. With the method, the power system is partitioned into several partitions to simplify the calculation in the power system or to reduce the difficulty of controlling the power system according to an analysis result of the network structure.

BACKGROUND

As network structures of power systems become more and more complicated, there is huge difficulty in calculation of analysis and control of a whole power system network. It is an effective method to decrease the difficulty in calculation with which the power system is partitioned into a plurality of partitions each of which is simple in structure according to analysis of the structure network of the power system. In the conventional partition method for the power systems, on the one hand, when the power system is modeled, quasi-steady characteristics are not took into account, thus leading to inaccuracies in modeling; on the other hand, the number of partitions is determined by users due to a lack of research on methods for determining the number of partitions, resulting in inaccuracy and difficulty in practical application.

SUMMARY

The present disclosure seeks to solve the above problems. A partition method for a power system is provided. With the partition method, a number of partitions of the power system may be determined using a quasi-steady sensitivity matrix and a principal component analysis. The accuracy of the partition method is guaranteed and partition results may be adaptively adjusted.

According to embodiments of a first aspect of the present disclosure, there is provided a partition method for a power system. The partition method includes: obtaining a quasi-steady sensitivity matrix according to generators participating in automatic voltage control and load buses in the power system; obtaining a power system model according to the quasi-steady sensitivity matrix and the load buses; determining principal component vectors and principal component singular values according to the power system model; determining a principal component vector dominated by each generator according to the principal component vectors and the principal component singular values; and partitioning the generators dominating a same principal component vector to a partition, and partitioning the load buses according to a partition result for the generators.

In an embodiment, obtaining a quasi-steady sensitivity matrix according to generators participating in automatic voltage control and load buses in the power system includes: configuring a $j^{th}$ generator as a PQ node, generators with voltage regulation abilities not reaching a limit of generators other than the $j^{th}$ generator as PV nodes and generators with voltage regulation abilities reaching the limit of generators other than the $j^{th}$ generator as PQ nodes, wherein $1 \le j \le g$ and g is a number of the generators; adding a predetermined large value to diagonal elements corresponding to the PV nodes in the a susceptance matrix to obtain a calculated susceptance matrix, wherein the susceptance matrix is a $(g+n)\times(g+n)$ matrix and n is a number of the load buses; performing a matrix inversion on the calculated susceptance matrix to obtain an inverse susceptance matrix; determining elements in the inverse susceptance matrix which are located in a $j^{th}$ column and rows corresponding to the load buses as a $j^{th}$ column of the quasi-steady sensitivity matrix, in which there are n rows in the quasi-steady sensitivity matrix, a $i^{th}$ row of the quasi-steady sensitivity matrix represents a $i^{th}$ load bus, $1 \le i \le n$ an element located in the $i^{th}$ row and the $j^{th}$ column represents a sensitivity value of the $j^{th}$ generator relative to the $i^{th}$ load bus.

In an embodiment, obtaining a power system model according to the quasi-steady sensitivity matrix and the load buses includes: determining space coordinates corresponding to the load buses according to the quasi-steady sensitivity matrix, wherein a space coordinate corresponding to a $i^{th}$ load bus is defined as $$C_i=(-\log|S_{i,1}|,-\log|S_{i,2}|, \ldots ,-\log|S_{i,j}|, \ldots , -\log|S_{i,g}|),$$

where $S_{i,j}$ is an element located in a $i^{th}$ row and a $j^{th}$ column of the quasi-steady sensitivity matrix, $1 \le i \le n$, n is a number of the load buses, $1 \le j \le g$ and g is a number of the generator; and collecting the space coordinates corresponding to the load buses to form the power system model.

In an embodiment, determining principal component vectors and principal component singular values according to the power system model includes: constructing a sample matrix according to the power system model; constructing a sample correlation matrix according to the sample matrix; calculating singular values of the sample correlation matrix; determining a number of principal components and the principal component vectors according to the singular values of the sample correlation matrix, and determining singular values corresponding to principal components as the principal component singular values.

In an embodiment, the sample matrix is defined as $$X=\{X_{i,j}=-\log|S_{i,j}|\}_{n\times g},$$

where $S_{i,j}$ is an element located in a $i^{th}$ row and a $j^{th}$ column of the quasi-steady sensitivity matrix, $1 \le i \le n$, $1 \le j \le g$ and n is a number of rows of the quasi-steady sensitivity matrix and g is a number of columns of the quasi-steady sensitivity matrix;

and the sample correlation matrix is defined as $$R=\left\{R_{mt}=\frac{\mathrm{cov}(X_m, X_t)}{\sqrt{\mathrm{cov}(X_m, X_m)\mathrm{cov}(X_t, X_t)}}\right\}_{g\times g},$$

where $X_m$ and $X_t$ represent a $m^{th}$ column and a $t^{th}$ column of the sample matrix respectively and $\mathrm{cov}(X_m,X_t)$ is a covariance between $X_m$ and $X_t$, $1 \le m \le g$ and $1 \le t \le g$.

In an embodiment, determining a number of principal components and the principal component vectors according to the singular values of the sample correlation matrix includes: sorting the singular values from largest to smallest to obtain a permutation which is expressed as $\lambda_1, \lambda_2, \ldots, \lambda_g$;

defining the number of principal components of the sample correlation matrix according to the singular values as $$p = \min\left\{ q \left| \frac{\sum_{l=1}^{q} \lambda_l}{\sum_{l=1}^{g} \lambda_l} > 0.85, \frac{\lambda_{q+1}}{\sum_{l=1}^{q} \lambda_l} \le 0.05 \right. \right\},$$

where $\lambda_l$ is a $l^{th}$ element in the permutation, $\lambda_{q+1}$ is a $(q+1)^{th}$ element in the permutation and q is a positive integer satisfying $1 \le q \le n$ and $$\frac{\sum_{l=1}^{q} \lambda_l}{\sum_{l=1}^{g} \lambda_l} > 0.85, \frac{\lambda_{q+1}}{\sum_{l=1}^{q} \lambda_l} \le 0.05;$$

and determining eigenvectors of a matrix $R^T R$ which are corresponding to first p singular values in the permutation as the principal component vectors, where $R^T$ is a transposed matrix of R, R represents the sample correlation matrix.

In an embodiment, determining a principal component vector dominated by each generator according to the principal component vectors and the principal component singular values includes: constructing a factor load matrix according to the number of principal components, the principal component vectors and the principal component singular values, wherein the factor load matrix comprises vectors obtained according to the principal component vectors and the principal component singular values, each row represents each generator and each column represents each principal component vector; determining a row corresponding to each principal component vector to obtain the principal component vector dominated by each generator, wherein an element with maximum absolute value in a row corresponding to each generator in the factor load matrix is defined as the principal component vector dominated by the generator.

In an embodiment, the factor load matrix is defined as $A=(\sqrt{\lambda_1}\alpha_1, \ldots, \sqrt{\lambda_k}\alpha_k, \ldots, \sqrt{\lambda_p}\alpha_p)$, wherein each row of the factor load matrix corresponds to a generator and each column of the factor load matrix corresponds to a principal component, where A is a g×p matrix, $\lambda_k$ is a principal component singular value and $\alpha_k$ is a principal component vector, $1 \le k \le p$.

In an embodiment, partitioning the load buses according to the partition result for the generators includes: determining a generator corresponding to an element which is a maximum element located in each row corresponding to each load bus in the quasi-steady sensitivity matrix as a generator corresponding to the each load bus; and partitioning each load bus into the partition including the generator corresponding to the each load bus.

According to embodiments of a second aspect of the present disclosure, there is provided a partition device for a power system. The partition device includes: a first obtaining module, configured to obtain a quasi-steady sensitivity matrix according to generators participating in automatic voltage control and load buses in the power system; a second obtaining module, configured to obtain a power system model according to the quasi-steady sensitivity matrix and the load buses; a first determining module, configured to determine principal component vectors and principal component singular values according to the power system model; a second determining module, configured to determine a principal component vector dominated by each generator according to the principal component vectors and the principal component singular values; a partitioning module, configured to partition the generators dominating a same principal component to a partition, and partitioning the load buses according to a partition result for the generators.

In an embodiment, the first obtaining module includes: a configuring sub-module, configured to configure a $j^{th}$ generator as a PQ node, generators with voltage regulation abilities not reaching a limit of generators other than the $j^{th}$ generator as PV nodes and generators with voltage regulation abilities reaching the limit of generators other than the $j^{th}$ generator as PQ nodes, wherein $1 \le j \le g$ and g is a number of the generators; an adding sub-module, configured to add a predetermined large value to diagonal elements corresponding to the PV nodes in the a susceptance matrix to obtain a calculated susceptance matrix, wherein the susceptance matrix is a $(g+n)\times(g+n)$ matrix and n is a number of the load buses; a performing sub-module, configured to perform a matrix inversion on the calculated susceptance matrix to obtain an inverse susceptance matrix; and a first determining sub-module, configured to determine elements in the inverse susceptance matrix which are located in a $j^{th}$ column and rows corresponding to the load buses as a $j^{th}$ column of the quasi-steady sensitivity matrix, in which there are n rows in the quasi-steady sensitivity matrix, a $i^{th}$ row of the quasi-steady sensitivity matrix represents a $i^{th}$ load bus, $1 \le i \le n$, an element located in the $i^{th}$ row and the $j^{th}$ column represents a sensitivity value of the $j^{th}$ generator relative to the $i^{th}$ load bus.

In an embodiment, the second obtaining module includes: a second determining sub-module, configured to determine space coordinates corresponding to the load buses according to the quasi-steady sensitivity matrix, wherein a space coordinate corresponding to a $i^{th}$ load bus is defined as $$C_i=(-\log|S_{i,1}|,-\log|S_{i,2}|, \ldots ,-\log|S_{i,j}|, \ldots , -\log|S_{i,g}|),$$

where $S_{i,j}$ is an element located in a $i^{th}$ row and a $j^{th}$ column of the quasi-steady sensitivity matrix, $1 \le i \le n$, n is a number of the load buses, $1 \le j \le g$ and g is a number of the generator; and a collecting sub-module, configured to collect the space coordinates corresponding to the load buses to form the power system model.

In an embodiment, the first determining module includes: a first constructing sub-module, configured to construct a sample matrix according to the power system model; a second constructing sub-module, configured to construct a sample correlation matrix according to the sample matrix; a first calculating sub-module, configured to calculate singular values of the sample correlation matrix; a third determining sub-module, configured to determine a number of principal components and the principal component vectors according to the singular values of the sample correlation matrix, and to determine singular values corresponding to principal components as the principal component singular values.

In an embodiment, the sample matrix is defined as $$X=\{X_{i,j}=-\log|S_{i,j}|\}_{n\times g},$$

where $S_{i,j}$ is an element located in a $i^{th}$ row and a $j^{th}$ column of the quasi-steady sensitivity matrix, $1 \le i \le n$, $1 \le j \le g$ and n is a number of rows of the quasi-steady sensitivity matrix and g is a number of columns of the quasi-steady sensitivity matrix;

and the sample correlation matrix is defined as $$R = \left\{ R_{mt} = \frac{\mathrm{cov}(X_m, X_t)}{\sqrt{\mathrm{cov}(X_m, X_m)\mathrm{cov}(X_t, X_t)}} \right\}_{g\times g},$$

where $X_m$ and $X_t$ represent a $m^{th}$ column and a $t^{th}$ column of the sample matrix respectively and $\mathrm{cov}(X_m, X_t)$ is a covariance between $X_m$ and $X_t$, $1 \le m \le g$ and $1 \le t \le g$.

In an embodiment, the third determining sub-module is configured to sort the singular values from largest to smallest to obtain a permutation which is expressed as $\lambda_1, \lambda_2, \ldots, \lambda_g$;

define the number of principal components of the sample correlation matrix according to the singular values as $$p = \min\left\{ q \left| \frac{\sum_{l=1}^{q} \lambda_l}{\sum_{l=1}^{g} \lambda_l} > 0.85, \frac{\lambda_{q+1}}{\sum_{l=1}^{q} \lambda_l} \le 0.05 \right. \right\},$$

where $\lambda_l$ is a $l^{th}$ element in the permutation, $\lambda_{q+1}$ is a (q+1) element in the permutation and q is a positive integer satisfying $1 \le q \le n$ and $$\frac{\sum_{l=1}^{q} \lambda_l}{\sum_{l=1}^{g} \lambda_l} > 0.85, \frac{\lambda_{q+1}}{\sum_{l=1}^{q} \lambda_l} \le 0.05;$$

and determine eigenvectors of a matrix $R^T R$ which are corresponding to first p singular values in the permutation as the principal component vectors, where $R^T$ is a transposed matrix of R, R represents the sample correlation matrix.

In an embodiment, the second determining module includes: a third constructing sub-module, configured to construct a factor load matrix according to the number of principal components, the principal component vectors and the principal component singular values, in which the factor load matrix comprises vectors obtained according to the principal component singular values and the principal component singular values, each row represents each generator and each column represents each principal component vector; a fourth determining sub-module, configured to determine a row corresponding to each principal component vector to obtain the principal component vector dominated by each generator, in which an element with maximum absolute value in a row corresponding to a generator in the factor load matrix is defined as the principal component vector dominated by the generator.

In an embodiment, the factor load matrix is defined as $A = (\sqrt{\lambda_1}\alpha_1, \ldots, \sqrt{\lambda_k}\alpha_k, \ldots, \sqrt{\lambda_p}\alpha_p)$, wherein each row of the factor load matrix corresponds to a generator and each column of the factor load matrix corresponds to a principal component, where A is a g×p matrix, $\lambda_k$ is a principal component singular value and $\alpha_k$ is a principal component vector, $1 \le k \le p$.

In an embodiment, the partitioning module is configured to partition the load buses according to the partition result for the generators by steps of: determining a generator corresponding to an element which is a maximum element located in each row corresponding to each load bus in the quasi-steady sensitivity matrix as a generator corresponding to the each load bus; and partitioning each load bus into the partition including the generator corresponding to the each load bus.

According to embodiments of a third aspect of the present disclosure, there is provided a non-transitory computer-readable storage medium having stored therein instructions, in which executed by a computer, to perform a partition method for a power system, in which the partition method comprises steps of: obtaining a quasi-steady sensitivity matrix according to generators participating in automatic voltage control and load buses in the power system; obtaining a power system model according to the quasi-steady sensitivity matrix and the load buses; determining principal component vectors and principal component singular values according to the power system model; determining a principal component vector dominated by each generator according to the principal component vectors and the principal component singular values; and partitioning the generators dominating a same principal component vector to a partition, and partitioning the load buses according to a partition result for the generators.

The present disclosure has the following two advantages.

(1) the accuracy of modeling: in the present disclosure, it is reflected that generators in a power system have the function of stabilizing the voltage by adding a large number to diagonal elements in a susceptance matrix. Since quasi-steady characteristics are considered, the accuracy of modeling a power system is improved.

(2) determining the number of partitions adaptively: the number of partitions of a power system may be determined through mathematics with principal component analysis instead of being determined by users, so the veracity of the method is assured. Additional, in practical application, the method which is independent of manual intervention may track changes of system structures and adjust partition results adaptively.

Additional aspects and advantages of embodiments of present invention will be given in part in the following descriptions, become apparent in part from the following descriptions, or be learned from the practice of the embodiments of the present invention.

BRIEF DESCRIPTION OF THE DRAWINGS

These and other aspects and advantages of embodiments of the present invention will become apparent and more readily appreciated from the following descriptions made with reference to the accompanying drawings, in which.

DETAILED DESCRIPTION

Figure 1:
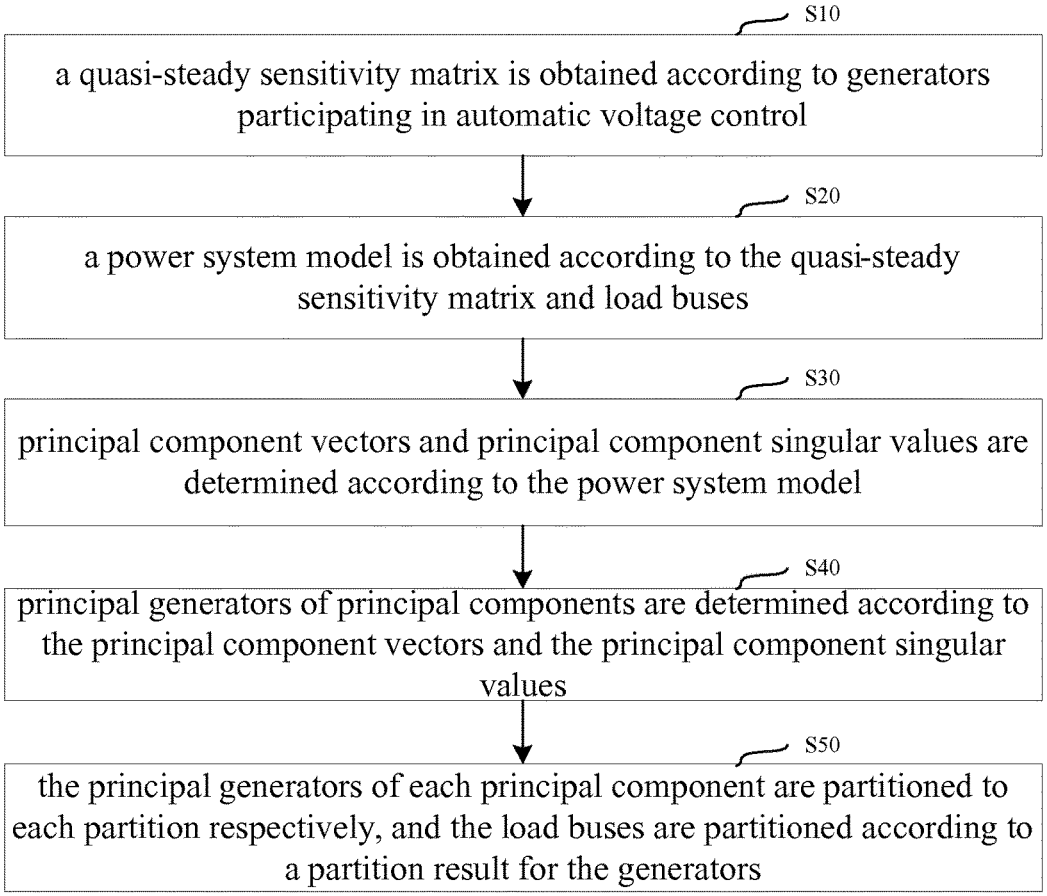
FIG. 1 is a flow chart of the partition method for a power system according to an embodiment of the present disclosure.

Reference will be made in detail to embodiments of the present disclosure. Embodiments of the present disclosure will be shown in drawings, in which the same or similar elements and the elements having same or similar functions are denoted by like reference numerals throughout the descriptions. The embodiments described herein according to drawings are explanatory and illustrative, not construed to limit the present disclosure.

The present disclosure provides a partition method for a power system. In the following, the partition method for a power system according to an embodiment of the present disclosure will be described with reference to accompanying drawings.

FIG. 1 is a flow chart of the partition method for a power system according to an embodiment of the present disclosure, as shown in FIG. 1, the partition method includes following steps.

At step S10, a quasi-steady sensitivity matrix is obtained according to generators participating in automatic voltage control and load buses in the power system.

For example, there are g generators participating in automatic voltage control and n load buses in the power system, thus a generator ensemble G including g generators and a load bus ensemble L including n load buses may be obtained.

In an embodiment, the quasi-steady sensitivity matrix may be obtained by the following steps.

At step S101: a $j^{th}$ generator is configured as a PQ node, generators with voltage regulation abilities not reaching a limit of generators other than the $j^{th}$ generator are configured as PV nodes and generators with voltage regulation abilities reaching the limit of generators other than the $j^{th}$ generator are configured as PQ nodes, in which $1 \le j \le g$.

At step 102, a predetermined large value is added to diagonal elements corresponding to the PV nodes in the a susceptance matrix comprising the PV nodes to obtain a calculated susceptance matrix.

Specifically, a $(g+n)\times(g+n)$ matrix is determined as a susceptance matrix B" corresponding to the power system.

At step S103, a matrix inversion is performed on the calculated susceptance matrix to obtain an inverse susceptance matrix.

At step S104, elements in the inverse susceptance matrix which are located in a $j^{th}$ column and rows corresponding to the load buses are determined as a $j^{th}$ column of the quasi-steady sensitivity matrix, in which there are n rows in the quasi-steady sensitivity matrix, a $i^{th}$ row of the quasi-steady sensitivity matrix represents a $i^{th}$ load bus, $1 \le i \le n$ an element located in the $i^{th}$ row and the $j^{th}$ column represents a sensitivity value of the $j^{th}$ generator relative to the $i^{th}$ load bus.

For example, assuming that n=3, g=4 (i.e. there are three load buses in L and four generators in G) and the voltage regulation ability of the second generator does not reach the limit and the voltage regulation ability of the third generator does not reach the limit while the voltage regulation ability of the first generator reaches the limit and the voltage regulation ability of the fourth generator reaches the limit, let j=1, the sensitivity values of the first generator in G relative to the load buses in L may be calculated.

Firstly, the first generator in G is configured as the PQ node, the second generator and the third generator are configured as the PV nodes and the fourth generator is configured as the PQ node.

Secondly, the susceptance matrix B" corresponding to the power system is determined, the susceptance matrix is a 7×7 matrix, the element $B''_{yz}$ located in a $y^{th}$ row and a $z^{th}$ column represents a susceptance value, if $1 \le y \le 4$, $1 \le z \le 4$ $B''_{yz}$ is a susceptance value of the $y^{th}$ generator relative to the $z^{th}$ generator; if $4 \le y \le 7$, $4 \le z \le 7$, $B''_{yz}$ is a susceptance value of the $(y-4)^{th}$ load bus relative to the $(z-4)^{th}$ load bus; if $4 \le y \le 7$, $1 \le z \le 4$, $B''_{yz}$ is a susceptance value of the $(y-4)^{th}$ load bus relative to the $z^{th}$ generator; if $1 \le y \le 4$, $4 \le z \le 7$, $B''_{yz}$ is a susceptance value of the $y^{th}$ generator relative to the $(z-4)^{th}$ load bus.

Thirdly, the predetermined large value (the scope of the predetermined large value may be 10000 to 1000000, such as 100000) is added to $B''_{22}$ and $B''_{33}$ (i.e. the diagonal elements in the susceptance matrix which are corresponding to the PV nodes) respectively to obtain a calculated susceptance matrix D.

Fourthly, matrix inversion of the calculated susceptance matrix D is performed to obtain an inverse susceptance matrix $D^{-1}$.

Fifthly, the element $D^{-1}_{15}$ is the sensitivity value of the first generator in G relative to the first load bus in L, the element $D^{-1}_{16}$ is the sensitivity value of the first generator in G relative to the second load bus in L, the element $D^{-1}_{17}$ is the sensitivity value of the first generator in G relative to the third load bus in L.

Let j=2/3/4, the sensitivity values of the second/third/fourth generator in G relative to the load buses in L may be calculated by the above steps.

As described in the above example, a quasi-steady sensitivity matrix S is obtained, the sensitivity matrix S is a 3×4 matrix, the elements located in the first/second/third/fourth column are the sensitivity values of the first/second/third/fourth generator in G relative to the load buses in L.

At step S20, a power system model is obtained according to the quasi-steady sensitivity matrix and load buses.

In an embodiment, the power system model is obtained according to the quasi-steady sensitivity matrix and load buses by following steps.

At step 201: space coordinates corresponding to the load buses are determined according to the quasi-steady sensitivity matrix.

A space coordinate corresponding to a $i^{th}$ load bus may be defined as $$C_i=(-\log|S_{i,1}|,-\log|S_{i,2}|,\ldots,-\log|S_{i,j}|,\ldots,-\log|S_{i,g}|),$$

where $S_{i,j}$ is an element located in the $i^{th}$ row and the $j^{th}$ column of the quasi-steady sensitivity matrix S, $1 \le i \le n$, $1 \le j \le g$.

At step 202: the space coordinates corresponding to the load buses are collected to form the power system model.

In other word, each load bus in the load bus ensemble L is corresponding to one space coordinate in a linear space of the power system, and then various space coordinates in the linear space form the power system model.

The power system may be partitioned based on the power system model by performing a principal component analysis, which may be descripted as follows in detail.

At step S30, principal component vectors and principal component singular values are determined according to the power system model.

In an embodiment, the principal component vectors and the principal component singular values are determined according to the power system model by following steps.

At step S301: a sample matrix is constructed according to the power system model.

The sample matrix may be defined as $$X=\{X_{i,j}=-\log|S_{i,j}|\}_{n\times g},$$

where X is the sample matrix, $S_{i,j}$ is the element located in the $i^{th}$ row and the $j^{th}$ column of the quasi-steady sensitivity matrix S, $1 \le i \le n$, $1 \le j \le g$ and n is a number of rows of the quasi-steady sensitivity matrix and g is a number of columns of the quasi-steady sensitivity matrix.

At step S302: a sample correlation matrix is constructed according to the sample matrix.

The sample correlation matrix may be defined as $$R=\left\{R_{mt}=\frac{\mathrm{cov}(X_m, X_t)}{\sqrt{\mathrm{cov}(X_m, X_m)\mathrm{cov}(X_t, X_t)}}\right\}_{g\times g},$$

where $X_m$ and $X_t$ represent a $m^{th}$ column and a $t^{th}$ column of the sample matrix X respectively and $cov(X_m,X_t)$ is a covariance between $X_m$ and $X_t$, $1 \le m \le g$ and $1 \le t \le g$.

At step S303: singular values of the sample correlation matrix are calculated.

At step S304: a number of principal components and the principal component vectors of the sample correlation matrix are determined according to the singular values of the sample correlation matrix, singular values corresponding to principal components are determined as the principal component singular values.

In an embodiment, the number of principal components and the principal component vectors of the sample correlation matrix may be determined according to the singular values of the sample correlation matrix by the following steps.

(1) the singular values are sorted from largest to smallest to obtain a permutation which is expressed as $\lambda_1, \lambda_2, \ldots, \lambda_g$.

(2) the number of principal components of the sample correlation matrix is defined according to the singular values as $$p = \min\left\{ q \left| \frac{\sum_{l=1}^{q} \lambda_l}{\sum_{l=1}^{g} \lambda_l} > 0.85, \frac{\lambda_{q+1}}{\sum_{l=1}^{q} \lambda_l} \le 0.05 \right. \right\},$$

where $\lambda_l$ is a $l^{th}$ element in the permutation, $\lambda_{q+1}$ is a $(q+1)^{th}$ element in the permutation and q is a positive integer satisfying $1 \le q \le n$ and $$\frac{\sum_{l=1}^{q} \lambda_l}{\sum_{l=1}^{g} \lambda_l} > 0.85, \frac{\lambda_{q+1}}{\sum_{l=1}^{q} \lambda_l} \le 0.05.$$

(3) eigenvectors of the matrix $R^T R$ which are corresponding to the first p singular values in the permutation are determined as the principal component vectors, where $R^T$ is the transposed matrix of R, R represents the sample correlation matrix.

At step S40, a principal component vector dominated by each generator is determined according to the principal component vectors and the principal component singular values.

In an embodiment, step S40 includes following steps.

At step S401: a factor load matrix is constructed according to the number of principal components, the principal component vectors and the principal component singular values, in which the factor load matrix includes vectors obtained according to the principal component vectors and the principal component singular values, each row represents each generator and each column represents each principal component vector.

Specifically, the factor load matrix may be defined as $A=(\sqrt{\lambda_1}\alpha_1, \ldots, \sqrt{\lambda_k}\alpha_k, \ldots, \sqrt{\lambda_p}\alpha_p)$ each row of which is corresponding to a generator and each column of which is corresponding to a principal component vector, where A is a $g \times p$ matrix, $\lambda_k$ is a principal component singular value and $\alpha_k$ is a principal component vector, $1 \le k \le p$.

At step S402: a row corresponding to each principal component vector is determined to obtain the principal component vector dominated by each generator, in which an element with maximum absolute value in a row corresponding to a generator in the factor load matrix is defined as the principal component vector dominated by the generator.

For example, the first row of the factor load matrix corresponding to the first generator in G. If the element located in the first row and the $k^{th}$ $(1 \le k \le p)$ column is the element with maximum absolute value in the first row, the element is the $k^{th}$ principal component vector dominated by a first generator.

At step S50, the generators dominating a same principal component vector are partitioned to each partition respectively, and the load buses are partitioned according to a partition result for the generators.

If the $k^{th}$ principal component vector is dominated by the third generator in G while the $k^{th}$ principal component $(k-2)^{k-2}$ vector is dominated by the second generator and the $k^{th}$ principal component $(k-2)^{k-2}$ vector is dominated by the fourth generator, then the first generator in G and the third generator in G are partitioned into a partition, and the second generator in G and the fourth generator in G are partitioned into another partition.

Specifically, the load buses are partitioned according to the partition result for the generators by the following steps.

(1) a generator corresponding to an element which is the maximum element located in each row corresponding to each load bus in the quasi-steady sensitivity matrix is determined as a generator corresponding to the each load bus.

(2) each load bus is partitioned into the partition including the generator corresponding to the each load bus.

For example, the first row of the quasi-steady sensitivity matrix corresponding to the first load bus in L. If the element located in the first row and the $k^{th}$ $(1 \le k \le g)$ column is the maximum element in the first row, the generator corresponding to the element is the generator corresponding to the first load bus in L, i.e. the $k^{th}$ generator is corresponding to the first load bus in L. If the $k^{th}$ generator is partitioned into a first partition, then the first load bus in L is partitioned into the first partition.

The present disclosure provides a partition device for a power system.

Figure 2:
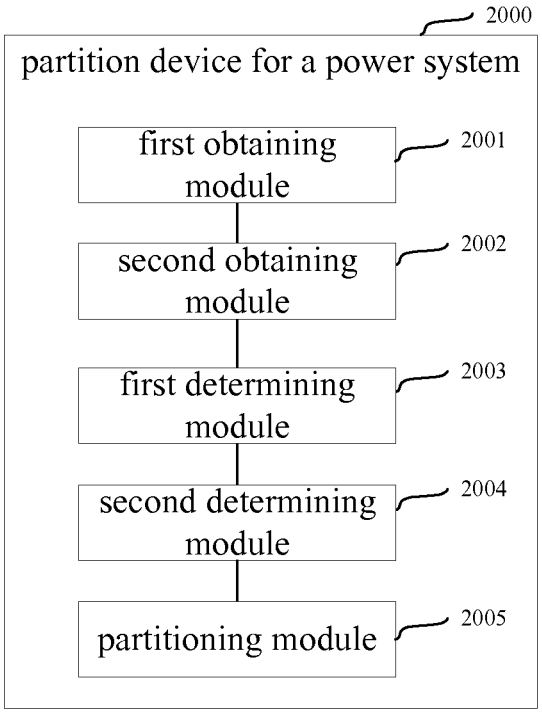
FIG. 2 is a block diagram of the partition device for a power system according to an embodiment of the present disclosure.

FIG. 2 is a block diagram of a partition device for a power system, as shown in FIG. 2, the partition device 2000 for a power system includes:

a first obtaining module 2001, configured to obtain a quasi-steady sensitivity matrix according to generators participating in automatic voltage control and load buses in the power system;

a second obtaining module 2002, configured to obtain a power system model according to the quasi-steady sensitivity matrix and the load buses;

a first determining module 2003, configured to determine principal component vectors and principal component singular values according to the power system model;

a second determining module 2004, configured to determine a principal component vector dominated by each generator according to the principal component vectors and the principal component singular values;

a partitioning module 2005, configured to partition the principal generators dominating a same principal component vector to a partition, and to partition the load buses according to a partition result for the generators.

In an embodiment, the first obtaining module 2001 includes:

a configuring sub-module, configured to configure a $j^{th}$ generator as a PQ node, generators with voltage regulation abilities not reaching a limit of generators other than the $j^{th}$ generator as PV nodes and generators with voltage regulation abilities reaching the limit of generators other than the $j^{th}$ generator as PQ nodes, wherein $1 \le j \le g$ and g is a number of the generators;

an adding sub-module, configured to add a predetermined large value to diagonal elements corresponding to the PV nodes in the a susceptance matrix to obtain a calculated susceptance matrix, wherein the susceptance matrix is a $(g+n)\times(g+n)$ matrix and n is a number of the load buses;

a performing sub-module, configured to perform a matrix inversion on the calculated susceptance matrix to obtain an inverse susceptance matrix; and a first determining sub-module, configured to determine elements in the inverse susceptance matrix which are located in a $j^{th}$ column and rows corresponding to the load buses as a $j^{th}$ column of the quasi-steady sensitivity matrix, in which there are n rows in the quasi-steady sensitivity matrix, a $i^{th}$ row of the quasi-steady sensitivity matrix represents a $i^{th}$ load bus, $1 \le i \le n$, an element located in the $i^{th}$ row and the $j^{th}$ column represents a sensitivity value of the $j^{th}$ generator relative to the $i^{th}$ load bus.

In an embodiment, the second obtaining module 2002 includes:

a second determining sub-module, configured to determine space coordinates corresponding to the load buses according to the quasi-steady sensitivity matrix, wherein a space coordinate corresponding to a $i^{th}$ load bus is defined as $$C_i=(-\log|S_{i,1}|,-\log|S_{i,2}|, \ldots ,-\log|S_{i,j}|, \ldots , -\log|S_{i,g}|),$$

where $S_{i,j}$ is an element located in a $i^{th}$ row and a $j^{th}$ column of the quasi-steady sensitivity matrix, $1 \le i \le n$, n is a number of the load buses, $1 \le j \le g$ and g is a number of the generator; and a collecting sub-module, configured to collect the space coordinates corresponding to the load buses to form the power system model.

the first determining module 2003 includes:

a first constructing sub-module, configured to construct a sample matrix according to the power system model, in which the sample matrix is defined as $$X=\{X_{i,j}=-\log|S_{i,j}|\}_{n\times g},$$

where $S_{i,j}$ is an element located in a $i^{th}$ row and a $j^{th}$ column of the quasi-steady sensitivity matrix, $1 \le i \le n$, $1 \le j \le g$ and n is a number of rows of the quasi-steady sensitivity matrix and g is a number of columns of the quasi-steady sensitivity matrix;

a second constructing sub-module, configured to construct a sample correlation matrix according to the sample matrix, in which the sample correlation matrix is defined as $$R = \left\{ R_{mt} = \frac{\mathrm{cov}(X_m, X_t)}{\sqrt{\mathrm{cov}(X_m, X_m)\mathrm{cov}(X_t, X_t)}} \right\}_{g\times g},$$

where $X_m$ and $X_t$ represent a $m^{th}$ column and a $t^{th}$ column of the sample matrix respectively and $\mathrm{cov}(X_m,X_t)$ is a covariance between $X_m$ and $X_t$, $1 \le m \le g$ and $1 \le t \le g$;

a first calculating sub-module, configured to calculate singular values of the sample correlation matrix;

a third determining sub-module, configured to determine a number of principal components and the principal component vectors according to the singular values of the sample correlation matrix, and to determine singular values corresponding to principal components as the principal component singular values.

In an embodiment, the third determining sub-module is configured to sort the singular values from largest to smallest to obtain a permutation which is expressed as $\lambda_1, \lambda_2, \ldots, \lambda_g$;

define the number of principal components of the sample correlation matrix according to the singular values as $$p = \min\left\{ q \left| \frac{\sum_{l=1}^{q} \lambda_l}{\sum_{l=1}^{g} \lambda_l} > 0.85, \frac{\lambda_{q+1}}{\sum_{l=1}^{q} \lambda_l} \le 0.05 \right. \right\},$$

where $\lambda_l$ is a $l^{th}$ element in the permutation, $\lambda_{q+1}$ is a $(q+1)^{th}$ element in the permutation and q is a positive integer satisfying $1 \le q \le n$ and $$\frac{\sum_{l=1}^{q} \lambda_l}{\sum_{l=1}^{g} \lambda_l} > 0.85, \frac{\lambda_{q+1}}{\sum_{l=1}^{q} \lambda_l} \le 0.05;$$

and determine eigenvectors of a matrix $R^TR$ which are corresponding to first p singular values in the permutation as the principal component vectors, where $R^T$ is a transposed matrix of R, R represents the sample correlation matrix.

In an embodiment, the second determining module 2004 includes:

a third constructing sub-module, configured to construct a factor load matrix according to the number of principal components, the principal component vectors and the principal component singular values, in which the factor load matrix comprises vectors obtained according to the principal component vectors and the principal component singular values, each row represents each generator and each column represents each principal component vector;

a fourth determining sub-module, configured to determine a row corresponding to each principal component vector to obtain the principal component vector dominated by each generator, in which an element with maximum absolute value in a row corresponding to a generator in the factor load matrix is defined as the principal component vector dominated by the generator.

In an embodiment, the factor load matrix is defined as $A=(\sqrt{\lambda_1}\alpha_1, \ldots, \sqrt{\lambda_k}\alpha_k, \ldots, \sqrt{\lambda_p}\alpha_p)$, in which each row of the factor load matrix corresponds to a generator and each column of the factor load matrix corresponds to a principal component vector, where A is a $g\times p$ matrix, $\lambda_k$ is a principal component singular value and $\alpha_k$ is a principal component vector, $1 \le k \le p$.

In an embodiment, the partitioning module 2005 is configured to partition the load buses according to the partition result for the generators by steps of:

determining a generator corresponding to an element which is a maximum element located in each row corresponding to each load bus in the quasi-steady sensitivity matrix as a generator corresponding to the each load bus; and partitioning each load bus into the partition including the generator corresponding to the each load bus.

The present disclosure further provides a non-transitory computer-readable storage medium having stored therein instructions, in which executed by a computer, to perform a partition method for a power system, in which the partition method includes steps of: obtaining a quasi-steady sensitivity matrix according to generators participating in automatic voltage control and load buses in the power system; obtaining a power system model according to the quasi-steady sensitivity matrix and the load buses; determining principal component vectors and principal component singular values according to the power system model; determining a principal component vector dominated by each generator according to the principal component vectors and the principal component singular values; and partitioning the generators dominating a same principal component vector to a partition, and partitioning the load buses according to a partition result for the generators.

Any process or method described in the flowing diagram or other means may be understood as a module, segment or portion including one or more executable instruction codes of the procedures configured to achieve a certain logic function or process, and the preferred embodiments of the present disclosure include other performances, in which the performance may be achieved in other orders instead of the order shown or discussed, such as in a almost simultaneous way or in an opposite order, which should be appreciated by those having ordinary skills in the art to which embodiments of the present disclosure belong.

The logic and/or procedures indicated in the flowing diagram or described in other means herein, such as a constant sequence table of the executable code for performing a logical function, may be implemented in any computer readable storage medium so as to be adopted by the code execution system, the device or the equipment (such a system based on the computer, a system including a processor or other systems fetching codes from the code execution system, the device and the equipment, and executing the codes) or to be combined with the code execution system, the device or the equipment to be used. With respect to the description of the present invention, "the computer readable storage medium" may include any device including, storing, communicating, propagating or transmitting program so as to be used by the code execution system, the device and the equipment or to be combined with the code execution system, the device or the equipment to be used. The computer readable medium includes specific examples (a non-exhaustive list): the connecting portion (electronic device) having one or more arrangements of wire, the portable computer disc cartridge (a magnetic device), the random access memory (RAM), the read only memory (ROM), the electrically programmable read only memory (EPROMM or the flash memory), the optical fiber device and the compact disk read only memory (CDROM). In addition, the computer readable storage medium even may be papers or other proper medium printed with program, as the papers or the proper medium may be optically scanned, then edited, interpreted or treated in other ways if necessary to obtain the program electronically which may be stored in the computer memory.

It should be understood that, each part of the present invention may be implemented by the hardware, software, firmware or the combination thereof. In the above embodiments of the present invention, the plurality of procedures or methods may be implemented by the software or hardware stored in the computer memory and executed by the proper code execution system. For example, if the plurality of procedures or methods is to be implemented by the hardware, like in another embodiment of the present invention, any one of the following known technologies or the combination thereof may be used, such as discrete logic circuits having logic gates for implementing various logic functions upon an application of one or more data signals, application specific integrated circuits having appropriate logic gates, programmable gate arrays (PGA), field programmable gate arrays (FPGA).

It can be understood by those having the ordinary skills in the related art that all or part of the steps in the method of the above embodiments can be implemented by instructing related hardware via programs, the program may be stored in a computer readable storage medium, and the program includes one step or combinations of the steps of the method when the program is executed.

In addition, each functional unit in the present disclosure may be integrated in one progressing module, or each functional unit exists as an independent unit, or two or more functional units may be integrated in one module. The integrated module can be embodied in hardware, or software. If the integrated module is embodied in software and sold or used as an independent product, it can be stored in the computer readable storage medium.

The computer readable storage medium may be, but is not limited to, read-only memories, magnetic disks, or optical disks.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

What is claimed is:

1. A partition method for a power system, comprising:

obtaining a quasi-steady sensitivity matrix according to generators participating in automatic voltage control and load buses in the power system;

obtaining a power system model according to the quasi-steady sensitivity matrix and the load buses;

determining principal component vectors and principal component singular values according to the power system model;

determining a principal component vector dominated by each generator according to the principal component vectors and the principal component singular values; and partitioning the generators dominating a same principal component vector to a partition, and partitioning the load buses according to a partition result for the generators.

2. The partition method according to claim 1, wherein obtaining a quasi-steady sensitivity matrix according to generators participating in automatic voltage control and load buses in the power system comprises:

configuring a $j^{th}$ generator as a PQ node, generators with voltage regulation abilities not reaching a limit of generators other than the $j^{th}$ generator as PV nodes and generators with voltage regulation abilities reaching the limit of the generators other than the $j^{th}$ generator as PQ nodes, wherein $1 \le j \le g$ and g is a number of the generators;

adding a predetermined large value to diagonal elements corresponding to the PV nodes in the a susceptance matrix to obtain a calculated susceptance matrix, wherein the susceptance matrix is a $(g+n)\times(g+n)$ matrix and n is a number of the load buses;

performing a matrix inversion on the calculated susceptance matrix to obtain an inverse susceptance matrix;

determining elements in the inverse susceptance matrix which are located in a $j^{th}$ column and rows corresponding to the load buses as a $j^{th}$ column of the quasi-steady sensitivity matrix, wherein there are n rows in the quasi-steady sensitivity matrix, a $i^{th}$ row of the quasi-steady sensitivity matrix represents a $i^{th}$ load bus, $1 \le i \le n$, an element located in the $i^{th}$ row and the $j^{th}$ column represents a sensitivity value of the $j^{th}$ generator relative to the $i^{th}$ load bus in the power system.

3. The partition method according to claim 1, wherein obtaining a power system model according to the quasi-steady sensitivity matrix and the load buses comprises:

determining space coordinates corresponding to the load buses according to the quasi-steady sensitivity matrix, wherein a space coordinate corresponding to a $i^{th}$ load bus is defined as $$C_i=(-\log|S_{i,1}|,-\log|S_{i,2}|, \ldots ,-\log|S_{i,j}|, \ldots , -\log|S_{i,g}|),$$

where $S_{i,j}$ is an element located in a $i^{th}$ row and a $j^{th}$ column of the quasi-steady sensitivity matrix, $1 \le i \le n$, n is a number of the load buses, $1 \le j \le g$ and g is a number of the generator; and collecting the space coordinates corresponding to the load buses to form the power system model.

4. The partition method according to claim 1, wherein determining principal component vectors and principal component singular values according to the power system model comprises:

constructing a sample matrix according to the power system model;

constructing a sample correlation matrix according to the sample matrix;

calculating singular values of the sample correlation matrix;

determining a number of principal components and the principal component vectors according to the singular values of the sample correlation matrix, and determining singular values corresponding to principal components as the principal component singular values.

5. The partition method according to claim 4, wherein the sample matrix is defined as $$X=\{X_{i,j}=-\log|S_{i,j}|\}_{n\times g},$$

where $S_{i,j}$ is an element located in a $i^{th}$ row and a $j^{th}$ column of the quasi-steady sensitivity matrix, $1 \le i \le n$, $1 \le j \le g$ and n is a number of rows of the quasi-steady sensitivity matrix and g is a number of columns of the quasi-steady sensitivity matrix;

and wherein the sample correlation matrix is defined as $$R=\left\{R_{mt}=\frac{\mathrm{cov}(X_m, X_t)}{\sqrt{\mathrm{cov}(X_m, X_m)\mathrm{cov}(X_t, X_t)}}\right\}_{g\times g},$$

where $X_m$ and $X_t$ represent a $m^{th}$ column and a $t^{th}$ column of the sample matrix respectively and $\mathrm{cov}(X_m,X_t)$ is a covariance between $X_m$ and $X_t$, $1 \le m \le g$ and $1 \le t \le g$.

6. The partition method according to claim 4, wherein determining a number of principal components and the principal component vectors according to the singular values of the sample correlation matrix comprises:

sorting the singular values from largest to smallest to obtain a permutation which is expressed as $\lambda_1, \lambda_2, \ldots, \lambda_g$;

defining the number of principal components of the sample correlation matrix according to the singular values as $$p=\min\left\{q \left| \frac{\sum_{l=1}^{q}\lambda_l}{\sum_{l=1}^{g}\lambda_l} > 0.85, \frac{\lambda_{q+1}}{\sum_{l=1}^{q}\lambda_l} \le 0.05 \right.\right\},$$

where $\lambda_l$ is a $l^{th}$ element in the permutation, $\lambda_{q+1}$ is a $(q+1)^{th}$ element in the permutation and q is a positive integer satisfying $1 \le q \le n$ and $$\frac{\sum_{l=1}^{q}\lambda_l}{\sum_{l=1}^{g}\lambda_l} > 0.85, \frac{\lambda_{q+1}}{\sum_{l=1}^{q}\lambda_l} \le 0.05;$$

and determining eigenvectors of a matrix $R^TR$ which are corresponding to first p singular values in the permutation as the principal component vectors, where $R^T$ is a transposed matrix of R, R represents the sample correlation matrix.

7. The partition method according to claim 6, wherein determining a principal component vector dominated by each generator according to the principal component vectors and the principal component singular values comprises:

constructing a factor load matrix according to the number of principal components, the principal component vectors and the principal component singular values, wherein the factor load matrix comprises vectors obtained according to the principal component vectors and the principal component singular values, each row represents each generator and each column represents each principal component vector;

determining a row corresponding to each principal component vector to obtain the principal component vector dominated by each generator, wherein an element with maximum absolute value in a row corresponding to a generator in the factor load matrix is defined as the principal component vector dominated by the generator.

8. The partition method according to claim 7, wherein the factor load matrix is defined as $A=(\sqrt{\lambda_1}\alpha_1, \ldots, \sqrt{\lambda_k}\alpha_k, \ldots, \sqrt{\lambda_p}\alpha_p)$, wherein each row of the factor load matrix corresponds to a generator and each column of the factor load matrix corresponds to a principal component vector, where A is a g×p matrix, $\lambda_k$ is a principal component singular value and $\alpha_k$ is a principal component vector, $1 \le k \le p$.

9. The partition method according to claim 8, wherein partitioning the load buses according to the partition result for the generators comprises:

determining a generator corresponding to an element which is a maximum element located in each row corresponding to each load bus in the quasi-steady sensitivity matrix as a generator corresponding to the each load bus; and partitioning each load bus into the partition including the generator corresponding to the each load bus.

10. A partition device for a power system, comprising:

a first obtaining module, configured to obtain a quasi-steady sensitivity matrix according to generators participating in automatic voltage control and load buses in the power system;

a second obtaining module, configured to obtain a power system model according to the quasi-steady sensitivity matrix and the load buses;

a first determining module, configured to determine principal component vectors and principal component singular values according to the power system model;

a second determining module, configured to determine a principal component vector dominated by each generator according to the principal component vectors and the principal component singular values;

a partitioning module, configured to partition the generators dominating a same principal component vector to a partition, and to partition the load buses according to a partition result for the generators.

11. The partition device according to claim 10, wherein the first obtaining module comprises:

a configuring sub-module, configured to configure a $j^{th}$ generator as a PQ node, generators with voltage regulation abilities not reaching a limit of generators other than the $j^{th}$ generator as PV nodes and generators with voltage regulation abilities reaching the limit of generators other than the $j^{th}$ generator as PQ nodes, wherein $1 \le j \le g$ and g is a number of the generators;

an adding sub-module, configured to add a predetermined large value to diagonal elements corresponding to the PV nodes in the a susceptance matrix to obtain a calculated susceptance matrix, wherein the susceptance matrix is a (g+n)×(g+n) matrix and n is a number of the load buses;

a performing sub-module, configured to perform a matrix inversion on the calculated susceptance matrix to obtain an inverse susceptance matrix; and a first determining sub-module, configured to determine elements in the inverse susceptance matrix which are located in a $j^{th}$ column and rows corresponding to the load buses as a $j^{th}$ column of the quasi-steady sensitivity matrix, wherein there are n rows in the quasi-steady sensitivity matrix, a $i^{th}$ row of the quasi-steady sensitivity matrix represents a $i^{th}$ load bus, $1 \le i \le n$, an element located in the $i^{th}$ row and the $j^{th}$ column represents a sensitivity value of the $j^{th}$ generator relative to the $i^{th}$ load bus.

12. The partition device according to claim 10, wherein the second obtaining module comprises:

a second determining sub-module, configured to determine space coordinates corresponding to the load buses according to the quasi-steady sensitivity matrix, wherein a space coordinate corresponding to a $i^{th}$ load bus is defined as $$C_i=(-\log|S_{i,1}|,-\log|S_{i,2}|, \ldots ,-\log|S_{i,j}|, \ldots , -\log|S_{i,g}|),$$

where $S_{i,j}$ is an element located in a $i^{th}$ row and a $j^{th}$ column of the quasi-steady sensitivity matrix, $1 \le i \le n$, n is a number of the load buses, $1 \le j \le g$ and g is a number of the generator; and a collecting sub-module, configured to collect the space coordinates corresponding to the load buses to form the power system model.

13. The partition device according to claim 10, wherein the first determining module comprises:

a first constructing sub-module, configured to construct a sample matrix according to the power system model;

a second constructing sub-module, configured to construct a sample correlation matrix according to the sample matrix;

a first calculating sub-module, configured to calculate singular values of the sample correlation matrix;

a third determining sub-module, configured to determine a number of principal components and the principal component vectors according to the singular values of the sample correlation matrix, and to determine singular values corresponding to principal components as the principal component singular values.

14. The partition device according to claim 13, wherein the sample matrix is defined as $$X=\{X_{i,j}=-\log|S_{i,j}|\}_{n\times g},$$

where $S_{i,j}$ is an element located in a $i^{th}$ row and a $j^{th}$ column of the quasi-steady sensitivity matrix, $1 \le i \le n$, $1 \le j \le g$ and n is a number of rows of the quasi-steady sensitivity matrix and g is a number of columns of the quasi-steady sensitivity matrix;

and wherein the sample correlation matrix is defined as $$R=\left\{R_{mt}=\frac{\mathrm{cov}(X_m, X_t)}{\sqrt{\mathrm{cov}(X_m, X_m)\mathrm{cov}(X_t, X_t)}}\right\}_{g\times g},$$

where $X_m$ and $X_t$ represent a $m^{th}$ column and a $t^{th}$ column of the sample matrix respectively and $\mathrm{cov}(X_m,X_t)$ is a covariance between $X_m$ and $X_t$, $1 \le m \le g$ and $1 \le t \le g$.

15. The partition device according to claim 10, wherein the third determining sub-module is configured to sort the singular values from largest to smallest to obtain a permutation which is expressed as $\lambda_1, \lambda_2, \ldots, \lambda_g$;

define the number of principal components of the sample correlation matrix according to the singular values as $$p=\min\left\{q \left| \frac{\sum_{l=1}^{q}\lambda_l}{\sum_{l=1}^{g}\lambda_l} > 0.85,\ \frac{\lambda_{q+1}}{\sum_{l=1}^{q}\lambda_l} \le 0.05 \right.\right\},$$

where $\lambda_l$ is a $l^{th}$ element in the permutation, $\lambda_{q+1}$ is a $(q+1)^{th}$ element in the permutation and q is a positive integer satisfying $1 \le q \le n$ and $$\frac{\sum_{l=1}^{q}\lambda_l}{\sum_{l=1}^{g}\lambda_l} > 0.85,\ \frac{\lambda_{q+1}}{\sum_{l=1}^{q}\lambda_l} \le 0.05;$$

and determine eigenvectors of a matrix $R^TR$ which are corresponding to first p singular values in the permutation as the principal component vectors, where $R^T$ is a transposed matrix of R, R represents the sample correlation matrix.

16. The partition device according to claim 15, wherein the second determining module comprises:

a third constructing sub-module, configured to construct a factor load matrix according to the number of principal components, the principal component vectors and the principal component singular values, wherein the factor load matrix comprises vectors obtained according to the principal component vectors and the principal component singular values, each row represents each generator and each column represents each principal component vector;

a fourth determining sub-module, configured to determine a row corresponding to each principal component vector to obtain the principal component vector dominated by each generator, wherein an element with maximum absolute value in a row corresponding to a generator in the factor load matrix is defined as the principal component vector dominated by the generator.

17. The partition device according to claim 16, wherein the factor load matrix is defined as $A=(\sqrt{\lambda_1}\alpha_1, \ldots, \sqrt{\lambda_k}\alpha_k, \ldots, \sqrt{\lambda_p}\alpha_p)$, wherein each row of the factor load matrix corresponds to a generator and each column of the factor load matrix corresponds to a principal component vector, where A is a g×p matrix, $\lambda_k$ is a principal component singular value and $\alpha_k$ is a principal component vector, $1 \le k \le p$.

18. The partition device according to claim 17, wherein the partitioning module is configured to partition the load buses according to the partition result for the generators by steps of:

determining a generator corresponding to an element which is a maximum element located in each row corresponding to each load bus in the quasi-steady sensitivity matrix as a generator corresponding to the each load bus; and partitioning each load bus into the partition including the generator corresponding to the each load bus.

19. A non-transitory computer-readable storage medium having stored therein instructions, when executed by a computer, to perform a partition method for a power system, wherein the partition method comprises steps of:

obtaining a quasi-steady sensitivity matrix according to generators participating in automatic voltage control and load buses in the power system;

obtaining a power system model according to the quasi-steady sensitivity matrix and the load buses;

determining principal component vectors and principal component singular values according to the power system model;

determining a principal component vector dominated by each generator according to the principal component vectors and the principal component singular values; and partitioning the generators dominating a same principal component vector to a partition, and partitioning the load buses according to a partition result for the generators.

* * * * *